United States Patent [19]

Shirai et al.

[11] Patent Number: 4,724,194

[45] Date of Patent: Feb. 9, 1988

[54] PHOTOCONDUCTIVE MEMBER

[75] Inventors: Naoko Shirai; Tatsuo Takeuchi, both of Tokyo, Japan

[73] Assignee: Canon Kabushiki Kaisha, Tokyo, Japan

[21] Appl. No.: 942,030

[22] Filed: Dec. 15, 1986

Related U.S. Application Data

[63] Continuation of Ser. No. 628,572, Jul. 6, 1984.

[30] Foreign Application Priority Data

Jul. 18, 1983 [JP] Japan ..... 58-129395

[51] Int. Cl.[4] ..... G03G 5/802

[52] U.S. Cl. ..... 430/84; 430/135; 430/136; 427/74

[58] Field of Search ..... 430/84, 135, 136

[56] References Cited

U.S. PATENT DOCUMENTS 4,062,681 12/1977 Lewis ..... 430/67

4,409,308 10/1983 Shimizu ..... 430/84

*Primary Examiner*—J. David Welsh

*Attorney, Agent, or Firm*—Fitzpatrick, Cella, Harper & Scinto

[57] ABSTRACT

A photoconductive member is provided, which comprises a support and a light receiving layer provided on said support containing an amorphous material comprising silicon atoms as the matrix, the free surface of said light receiving layer having a contact angle with water of 75° or higher.

7 Claims, 1 Drawing Figure

PHOTOCONDUCTIVE MEMBER

This application is a continuation of application Ser. No. 628,572, filed July 6, 1984, now abandoned.

BACKGROUND OF THE INVENTION

1. Field of the Invention

This invention relates to a photoconductive member having sensitivity to electromagnetic waves such as light (herein used in a broad sense, including untraviolet rays, visible light, infrared rays, X-rays and gamma-rays) and a device for producing the same.

2. Description of the Prior Art

Photoconductive materials, which constitute image forming members for electrophotography in solid state image pick-up devices or in the field of image formation, or photoconductive layers in manuscript reading devices, are required to have a high sensitivity, a high SN ratio (Photocurrent ($I_p$)/Dark current ($I_d$)), spectral characteristics matching to those of electromagnetic waves to be irradiated, a rapid response to light, a desired dark resistance value as well as no harmful effects to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid safety characteristic is very important.

From the standpoint as mentioned above, amorphous silicon in which dangling bonds are modified with mono-valent elements such as hydrogen or halogen atoms (hereinafter referred to as a-Si(H, X)) has recently attracted attention as a photoconductive material. For example, German Laid-Open Patent Publication Nos. 2746967 and 2855718 disclose its applications for use in image forming members for electrophotography, and German Laid-Open Patent Publication No. 2933411 its application for use in a photoconverting reading device. It is expected to be useful in an image forming member for electrophotography for excellent photoconductivity, friction resistance, heat resistance and relative ease in forming into a large area.

Generally speaking, when an image forming member for electrophotography is mounted on a copying machine and image formation is effected in a highly humid environment, a defect known as the image flow, accompanied with an unfocused image or a disappearance of image, will frequently occur. This is because products from corona discharge or paper powder attached on the surface of an image forming member absorb water to lower the surface resistance of the image forming member, whereby the image forming member can no longer retain the electrostatic latent image. It has been difficult to remove such attached materials selectively from the surface of an image forming member, and it is common to remove the attached materials by incorporating a substance having the effect of removing the attached materials through attrition in a developer. However, upon the effective removal of the attached materials, the surface layer will also be abraded little by little. Abrasion of the surface layer of the image forming member has deleterious effects on the photosensitive characteristics and image quality, despite preventing image defects such as image flow. Thus, this method is not necessarily a good technique for overcoming this problem.

In view of the above points, the present invention is based on a discovery, obtained as a result of extensive studies made comprehensively from the standpoints of applicability and utility of a-Si as a light-receiving member for image forming members for electrophotography, solid state image pick-up devices, reading devices, etc., that the surface of a photoconductive member, which is liable to cause image flow, has a very low contact angle with water. On the basis of this knowledge, studies have been made to enhance the contact angle of the surface of a photoconductive member with water. Consequently, it has now been found that the above problem can be overcome by making the contact angle with water of the surface of a light receiving layer containing an amorphous material comprising silicon atoms as the matrix, higher than a certain value. Products from corona discharge or paper powder may have some influence on the contact angle of the surface of a photoconductive member. The above effect may be postulated to be due to the fact that such deleterious effects due to the corona product or paper powder may be alleviated when the surface has originally a contact angle of a certain value or higher.

SUMMARY OF THE INVENTION

An object of the present invention is to provide a photoconductive member for electrophotography which is substantially free from image defects such as image flow and capable of giving an image of high quality.

According to one aspect of the present invention, there is provided a photoconductive member, comprising a support and a light receiving layer provided on said support containing an amorphous material comprising silicon atoms as the matrix, the free surface of said light receiving layer having a contact angle with water of 75° or higher.

DETAILED DESCRIPTION OF THE PREFERRED EMBODIMENT

Figure 1:
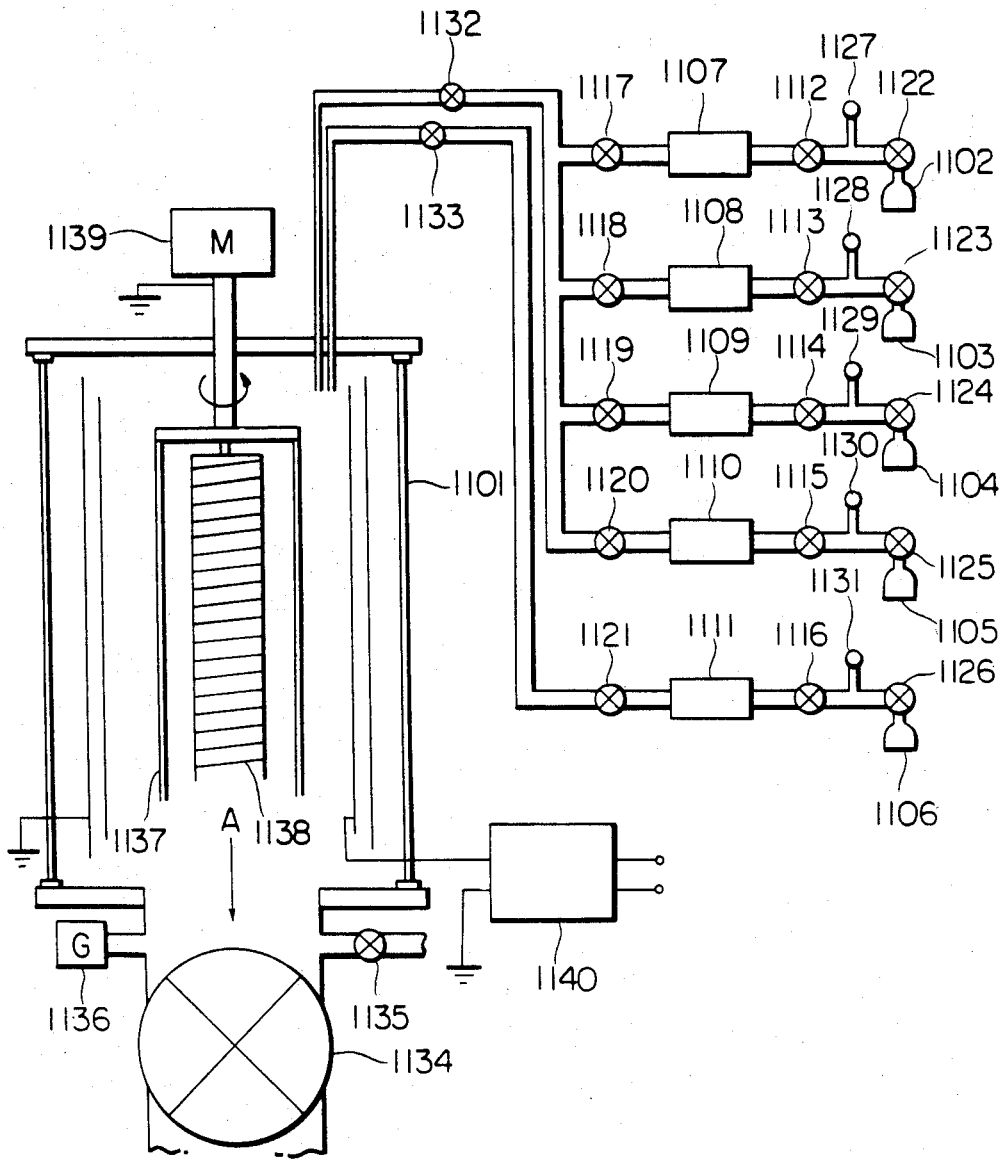
FIG. 1 shows a chart of a device for producing the photoconductive member according to the glow discharge decomposition method.

The photoconductive member of the present invention is constituted of a light receiving layer of at least one deposited layer provided on a support. The light receiving layer is constituted primarily of a deposited photoconductive layer containing generally a-Si(H, S) as the main component (hereinafter known as the photoconductive layer), and it is also possible to provide a lower deposited layer between the photoconductive layer and the support and/or an upper deposited layer on the photoconductive layer in any event, it is essential that the contact angle of the outermost surface (free surface) of the light receiving layer have a contact angle with water of 75° or higher.

Thus, if the surface of the light receiving layer has a contact angle with water of 75° or higher, even when employed as an image forming member for electrophotography under very high humidity the phenomenon of image flow will barely occur. On the other hand, with a contact angle with water of less than 75°, the image flow phenomenon is liable to occur, the frequency of occurrence being increased as this value is smaller. The contact angle of the surface of the light receiving layer with water as herein mentioned refers to an average value of the measured values at 5 or more points selected freely on the surface of the light receiving layer.

The photoconductive layer is constituted of silicon atoms as the matrix, containing preferably hydrogen atoms (H) and/or halogen atoms (X). The components other than these atoms may be Group III atoms of the periodic table, such as boron, gallium, etc., Group V atoms such as nitrogen, phosphorus, arsenic, etc., oxygen atoms, carbon atoms, germanium atoms, etc. singly or as a suitable combination, as the component for regulating the Fermi level or the forbidden gap width.

The lower deposited layer is provided for the purpose of improving adhesion between the photoconductive layer and the support or controlling the charge receiving ability. Depending on its purpose, one layer or multiple layers of a-Si(H, X) or microcrystalline Si(H, X) layer containing the group III atoms, the group V atoms, carbon atoms, germanium atoms, etc. may be so formed.

The upper layer provided as desired on the photoconductive layer is a layer acting as a surface charge injection preventing layer or the protective layer and is formed of a-Si(H, X) containing carbon atoms, nitrogen atoms, etc. preferably in a large amount.

On the other hand, the base material for the support may be either electroconductive or insulating. As the electroconductive support, there may be mentioned metals such as NiCr, stainless steel, Al, Cr, Mo, Au, Nb, Ta, V, Ti, Pt, Pd etc. or alloys thereof.

As insulating supports, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating supports may preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface.

However, as the base material for the support, it is preferred to use aluminum, because a support with good precision such as true circularity, surface smoothness, etc. can be obtained with relative ease; the temperature at the surface portion deposited of a-Si can be controlled easily, and also for economy.

The support may be shaped in any form as desired. For example, when the photoconductive member is to be used as an image forming member for electrophotography, it is desirably formed into an endless belt or a cylinder for use in continuous high speed copying. The support may have a thickness, which is conveniently determined so that a photoconductive member as desired may be formed. When the photoconductive member is required to have flexibility, the support is made as thin as possible, so far as the function of a support can be exhibited. However, in such a case, the thickness is generally 10μ or more from the standpoint of fabrication and handling of the support as well as its mechanical strength.

In the present invention, for formation of a photoconductive layer constituted of a-Si, it is possible to apply various vacuum deposition methods utilizing discharging phenomenon known in the art, such as the glow discharge method, the sputtering method or the ion plating method.

In the method for preparing the light receiving layer of the photoconductive member of the present invention, having a contact angle with water of 75° or higher, since the composition of the constituent atoms of the light receiving layer and various conditions for preparation of the light receiving are related to the contact angle, no single factor can effectively decide the contact angle. In most cases the desired angle can be attained through a synergetic action of two or more factors.

First, as the composition of the constituent atoms of the light receiving layer, the contact angle cannot be made 75° or higher merely by doping of the specific atoms as mentioned above. As the composition constituting the surface of the light receiving layer capable of accomplishing the above requirements with a relatively wide tolerable range, there may be included those of a-Si:C system, a-Si:C:H system, a-Si:C:F system, a-Si:C:F:H system as principal ones. Doping of a large amount of oxygen atoms at the surface of light receiving layer is not desirable, since the contact angle will be lowered thereby.

On the other hand, as the conditions for preparation of the surface portion of the light receiving layer, it is preferable to set the heating temperature of the support at relatively higher values (e.g. 230°–350° C.), while the discharging power at relatively lower values (e.g., 0.01–0.1 W/cm$^2$). It is also preferable to increase the evacuation speed and the feeding rates of starting gases to higher levels and to shorten the residence time of the starting gases in the reaction (deposition) device. Otherwise, it is also desirable to select a suitable means for permitting the deposition reaction on the surface of light receiving layer to proceed as smoothly as possible.

Also, in some cases, the process for forming the light receiving layer at portions other than the surface portion of light receiving layer may have some delicate effect on the contact angle of the surface portion with water. Thus, it is preferred to minimize the impurity (materials not participating in film formation) within the reaction device during formation of the light receiving layer. For this purpose, it is desirable to employ a reaction device capable of attaining a high vacuum degree, gases of high purity or to apply a suitable technique for cleaning of the device such as combination of introduction of ion impinging gas and evacuation cycle, etc. before or during film formation.

Further, post-treatment after completion of film formation of the light receiving layer may sometimes have a very sensitive action on improvement of the contact angle of the surface of light receiving layer with water. For example, annealing under high vacuum or in a suitable gas atmosphere such as argon, nitrogen, etc. or gentle ion impingement with a suitable gas plasma may be employed as effective technique.

By suitably selecting such various preparation conditions in connection with the desired composition of the constituent atoms of the light receiving layer, there can be prepared for the first time the photoconductive member of the present invention having a contact angle of the surface of the light receiving layer with water of 75° or higher.

In the following, an example of the method for preparation of a photoconductive member formed according to the glow discharge decomposition method is described.

FIG. 1 shows a device for preparation of a photoconductive member according to the glow discharge decomposition method.

In the gas bombs 1102–1106, there are hermetically contained starting gases for formation of the light receiving layer of the present invention. For example, 1102 is a $SiH_4$ bomb (purity: 99.99%), 1103 is a bomb containing $B_2H_6$ gas diluted with $H_2$ (purity: 99.99%, hereinafter abbreviated as "$B_2H_6/H_2$ gas") 1104 is a $NH_3$ gas bomb (purity: 99.99%), 1105 is a $CH_4$ gas bomb (purity: 99.99%) and 1106 is a $SiF_4$ gas bomb (purity: 99.99%). Other than these, although not shown in the drawing, it is also possible to provide additional bombs of desired gas species, if necessary.

For allowing these gases to flow into the reaction chamber 1101, it should be ascertained that the valves 1122–1126 of the gas bombs 1102–1106 and the leak valve 1135 be closed, the the inflow valves 1112–1116, the outflow valves 1117–1121 and the auxiliary valves 1132 and 1133 be opened, after which the main valve 1134 is opened to evacuate the reaction chamber 1101 and the gas pipelines. As the next step, when the reading on the vacuum indicator 1136 becomes about $10^{-6}$ Torr, the auxiliary valves 1132 and 1133 and the outflow valves 1117–1121 are closed. Then, $SiH_4$ gas from the gas bomb 1102, $B_2H_6/H_2$ gas from the gas bomb 1103, $NH_3$ gas from the gas bomb 1104, $CH_4$ gas from the gas bomb 1105 and $SiF_4$ gas from the gas bomb 1106 are permitted to flow into the mass-flow controllers 1107–1111, respectively, by controlling the pressures at the outlet pressure gauges 1127–1131 to 1 $Kg/cm^2$, respectively, by opening the valves 1122–1126 and opening gradually inflow valves 1112–1116. Subsequently, the outflow valves 1117–1121 and the auxiliary valves 1132 and 1133 are gradually opened to permit respective gases to flow into the reaction chamber 1101. The outflow valves 1117–1121 are controlled so that the flow rate ratio of the respective gases may have a desired value and opening of the main valve 1134 is also controlled, while watching the reading on the vacuum indicator 1136 so that the pressure in the reaction chamber may reach a desired value. After confirming that the temperature of the substrate cylinder 1137 is set at 230°–350° C. by the heater 1138, the power source 1140 is set at a desired power to excite glow discharge in the reaction chamber 1101.

At the same time, gas flow rate of the respective starting gases is suitably changed so that the desired distribution of the constituent atom contents previously designed may be obtained, and discharging power and the substrate temperature may be controlled, if desired, in the sense to compensate for the plasma conditions changed corresponding to the change in said gas flow rate, to form a light receiving layer.

During the layer formation, in order to effect uniformization of layer formation, the substrate cylinder 1137 is preferably rotated at a constant speed by means of a motor 1139.

When the light receiving layer is consituted of multiple layers, the above operation may be practiced repeatedly. During this operation, after formation of one layer, it is recommendable to evacuate the pressure in the reaction chamber once to about $10^{-6}$ Torr before formation of the next layer.

The photoconductive member in which formation of the light receiving layer has been completed is generally subjected to a post-treatment such as annealing or ion impingement as mentioned above before being removed from the reaction chamber.

The present invention is further illustrated by the following Examples

EXAMPLE 1

Using the device for preparation of photoconductive member shown in FIG. 1, layers were deposited in lamination on an aluminum cylinder according to the glow discharge decomposition method under the preparation conditions as shown in Table 1. Subsequently, the preparation device was evacuated to vacuum of about $10^{-6}$ Torr simultaneously with elevation of the cylinder temperature by 30° C. to 280° C., and 7 minutes later, the third layer (surface layer) was formed under the conditions shown in Table 2. After formation of the surface layer, the preparation device was again evacuated to about $10^{-6}$ Torr, and the photoconductive member having the completed light receiving layer was left to stand at 280° C. for about 30 minutes in the device. Then, the valve of the discharging pump was closed and nitrogen gas was introduced to a pressure of 100 Torr, and the photosensitive member was left to stand until the surface temperature lowered to room temperature.

The thus prepared photoconductive member was removed from the preparation device, water drops were applied dropwise on its surface to measure the contact angles at 10 positions freely selected on the surface to obtain the results as shown in Table 3. Thus, the contact angle of the surface of light receiving layer of this photoconductive member was determined to be 77.7°.

Next, this photoconductive member was mounted on a copying machine and image formation was practiced under the high temperature and high humidity environment of a temperature of 40° C. and a humidity of 90%. As the result, no such phenomenon as image flow was observed at all, and good results were obtained in evaluation items of density, resolution and gradation reproducibility. Also, when the same evaluation was practiced after image formation repeated for times corresponding to the total number of 100,000 sheets under the same environment, good image quality substantially unchanged from the initial state was found to be maintained.

TABLE 1

| Order of lamination | Gases and their amounts (SCCM) | Discharging power ($W/cm^2$) | Layer formation speed (Å/sec) | Layer thickness (μm) | Support temperature (°C.) | Discharging frequency (MHz) | Inner pressure during reaction (Torr) |
|---|---|---|---|---|---|---|---|
| First layer | $SiH_4$: 200<br>$B_2H_6$: 0.6 | 0.18 | 15 | 0.6 | 250 | 13.56 | 0.5 |
| Second | $SiH_4$: 200 | 0.18 | 15 | 20 | 250 | 13.56 | 0.5 |

TABLE 1-continued

| Order of lamination | Gases and their amounts (SCCM) | Discharging power (W/cm²) | Layer formation speed (Å/sec) | Layer thickness (μm) | Support temperature (°C.) | Discharging frequency (MHz) | Inner pressure during reaction (Torr) |
|---|---|---|---|---|---|---|---|
| layer | | | | | | | |

TABLE 2

| Order of lamination | Gases and their amounts (SCCM) | Discharging power (W/cm²) | Layer formation speed (Å/sec) | Layer thickness (μm) | Support temperature (°C.) | Discharging frequency (MHz) | Inner pressure during reaction (Torr) |
|---|---|---|---|---|---|---|---|
| Third layer | $SiH_4$: 20<br>$C_2H_4$: 500 | 0.3 | 1 | 0.1 | 280 | 13.56 | 0.5 |

TABLE 3

| Measurement site | 1 | 2 | 3 | 4 | 5 | 6 | 7 | 8 | 9 | 10 |
|---|---|---|---|---|---|---|---|---|---|---|
| Contact angle | 75° | 80° | 78° | 76° | 78° | 78° | 77° | 81° | 78° | 76° |

COMPARATIVE EXAMPLE 1

On the same aluminum cylinder as used in Example 1, a photoconductive member was prepared according to the preparation conditions as shown in Table 4. In this example, three light receiving layers were continuously formed, and the cylinder surface temperature was made constant during preparation of the light receiving layers. After light receiving layers were formed, the reaction device was directly opened to atmosphere and the photoconductive member was left to stand until the cylinder surface temperature lowered to room temperature. For the photoconductive member thus prepared, the contact angle with water was measured similarly as in Example 1 to obtain the results as shown in Table 5. The contact angle of the light receiving layer surface with water was found to be 70.0°.

When the same copying test as in Example 1 was practiced for the photoconductive member, image flow phenomenon occurred immediately after initiation of the test.

TABLE 4

| Order of lamination | Gases and their amounts (SCCM) | Discharging power (W/cm²) | Layer formation speed (Å/sec) | Layer thickness (μm) | Support temperature (°C.) | Discharging frequency (MHz) | Inner pressure during reaction (Torr) |
|---|---|---|---|---|---|---|---|
| First layer | $SiH_4$: 200<br>$B_2H_6$: 0.6 | 0.18 | 15 | 0.6 | 250 | 13.56 | 0.5 |
| Second layer | $SiH_4$: 200 | 0.18 | 15 | 20 | 250 | 13.56 | 0.5 |
| Third layer | $SiH_4$: 20<br>NO: 5 | 0.3 | 1 | 0.1 | 250 | 13.56 | 0.5 |

TABLE 5

| Measurement site | 1 | 2 | 3 | 4 | 5 | 6 | 7 | 8 | 9 | 10 |
|---|---|---|---|---|---|---|---|---|---|---|
| Contact angle | 68° | 70° | 69° | 69° | 71° | 72° | 72° | 70° | 69° | 70° |

EXAMPLE 2

A photoconductive member was prepared according to the same method as in Example 1 except for changing the conditions for preparation of the third layer (surface layer) as shown in Table 6. The contact angle of this photoconductive member with water was found to be 82.4°, and details of the measurement results are shown in Table 7.

Also for this photoconductive member, copying test was practiced similarly as in Example 1 to obtain good results as in Example 1.

TABLE 6

| Order of lamination | Gases and their amounts (SCCM) | Discharging power (W/cm²) | Layer formation speed (Å/sec) | Layer thickness (μm) | Support temperature (°C.) | Discharging frequency (MHz) | Inner pressure during reaction (Torr) |
|---|---|---|---|---|---|---|---|
| Third layer | $SiH_4$: 10<br>$SiF_4$: 10<br>$C_2H_4$: 500 | 0.3 | 1 | 0.1 | 280 | 13.56 | 0.5 |

TABLE 7

| Measurement site | 1 | 2 | 3 | 4 | 5 | 6 | 7 | 8 | 9 | 10 |
|---|---|---|---|---|---|---|---|---|---|---|
| Contact angle | 85° | 83° | 81° | 80° | 82° | 84° | 81° | 83° | 82° | 83° |

What we claim is:

1. A photoconductive member, comprising a support and a light receiving layer provided on said support containing an amorphous material comprising silicon atoms as the matrix, the free surface of said light receiving layer having a contact angle with water of 75° or higher.

2. A photoconductive member according to claim 1, wherein the light receiving layer has a laminated structure of a plural number of layers of different materials.

3. A photoconductive member according to claim 1, wherein carbon atoms are contained in the layer region including at least the free surface of the light receiving region.

4. A photoconductive member according to claim 1, wherein the nitrogen atoms are contained in the layer region including at least the free surface of the light receiving region.

5. A photoconductive member according to claim 1, wherein at least one of hydrogen atoms and halogen atoms are contained in the light receiving layer.

6. A photoconductive member according to claim 1 wherein the contact angle is measured by applying water drops to said free surface at at least 5 different points thereon, measuring each contact angle and determining the average value of said measured values.

7. A photoconductive member according to claim 1, having a cylindrical support.

* * * * *